United States Patent [19]

Warhurst et al.

[11] Patent Number: 4,777,980

[45] Date of Patent: Oct. 18, 1988

[54] ADJUSTMENT ASSEMBLY FOR VALVE SPOOL AND ASSOCIATED CENTERING SPRING

[75] Inventors: Terrel C. Warhurst, Oshkosh; David C. Entringer, Wautoma, both of Wis.

[73] Assignee: Brunswick Corporation, Skokie, Ill.

[21] Appl. No.: 55,797

[22] Filed: Jun. 1, 1987

[51] Int. Cl.[4] ..... F15B 13/04

[52] U.S. Cl. ..... 137/625.69; 251/337

[58] Field of Search ..... 137/625.69; 251/337

[56] References Cited

U.S. PATENT DOCUMENTS

| | | | |
|---|---|---|---|
| 2,924,239 | 2/1960 | Bjorklund | 137/625.69 |
| 3,405,735 | 10/1968 | Adams | 137/625.69 |
| 4,595,370 | 7/1986 | Small | 440/53 |

FOREIGN PATENT DOCUMENTS

| | | | |
|---|---|---|---|
| 2604890 | 9/1976 | Fed. Rep. of Germany | 137/625.69 |

*Primary Examiner*—Gerald A. Michalsky

*Attorney, Agent, or Firm*—Andrus, Sceales, Starke & Sawall

[57] ABSTRACT

An adjustment assembly for axially positioning the spool and associated centering spring within the bore of a valve body includes a cylindrical sleeve disposed around and connected to the cylindrical surface of the spool. The cylindrical sleeve includes radial surfaces that act to adjust the spring seats for the centering spring so that axial movement of the cylindrical sleeve results in axial movement of the spool and the spring seats for the centering spring.

7 Claims, 1 Drawing Sheet

ADJUSTMENT ASSEMBLY FOR VALVE SPOOL AND ASSOCIATED CENTERING SPRING

BACKGROUND OF THE INVENTION

The present invention relates to an adjustment assembly for positioning a valve spool and its associated centering spring within the bore of a valve body.

A power steering assembly for a marine drive employs a hydraulic assist to reduce steering loads to the operator. The steering arm of the marine drive is connected to a piston rod clevis of a hydraulic cylinder and the housing of the cylinder in turn is anchored to the boat. The steering wheel of the boat is connected through a steering cable to a movable valve that controls the direction and flow magnitude of the hydraulic fluid provided to the hydraulic cylinder. The operator of the boat thus needs only to exert enough effort to operate the valve and not that required to actually steer the boat. The hydraulic valve utilized in such a system is comprised of a valve body having a number of ports spaced along its length and containing a spool receiving bore. The spool is provide with a number of grooves and lands that cooperate with the various ports in the valve body to direct the flow of hydraulic fluid.

Typically, the valve spool has an associated centering spring which returns the valve spool to a neutral position when no external forces are applied to the spool. When assembling the valve or replacing parts within the valve, it is necessary that the valve spool be placed within the valve body at a very precise position so that the lands and grooves are precisely aligned with their associated ports in the valve body. Without such precise alignment, undesirable leakage would occur between the various ports.

A prior adjustment assembly described in U.S. Pat. No. 4,595,370 to Small utilized a snap ring to position the centering spring on an adjustment sleeve threaded into the valve body. This arrangement was difficult to manufacture and use because of clearance in the screw threads and the snap ring grooves. Further, a seal was loaded by the centering spring and could hang up in use.

Thus, it is an object of the present invention to provide an adjustment assembly that allows for the exact positioning of the valve spool within the valve body.

SUMMARY OF THE INVENTION

An adjustment assembly for axially positioning a spool and its associated centering spring within the bore of a valve body includes a cylindrical sleeve disposed around and connected to the cylindrical surface of the spool so that axial movement of the cylindrical sleeve results in axial movement of the spool.

In accordance with another aspect of the invention, the cylindrical sleeve includes a spring seat for one side of the centering spring so that axial movement of the cylindrical sleeve will result in axial movement of the spring seat.

In accordance with yet another aspect of the invention, the cylindrical sleeve is provided with an extension that contacts the spring seat for the other side of the spring. This second spring seat is allowed to move axially within a cavity in the valve body and axial movement of the cylindrical sleeves results in axial movement of the second spring seat.

The present invention thus provides an adjustment assembly that allows for axial positioning of the spool and simultaneously positions the centering spring associated with the spool.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
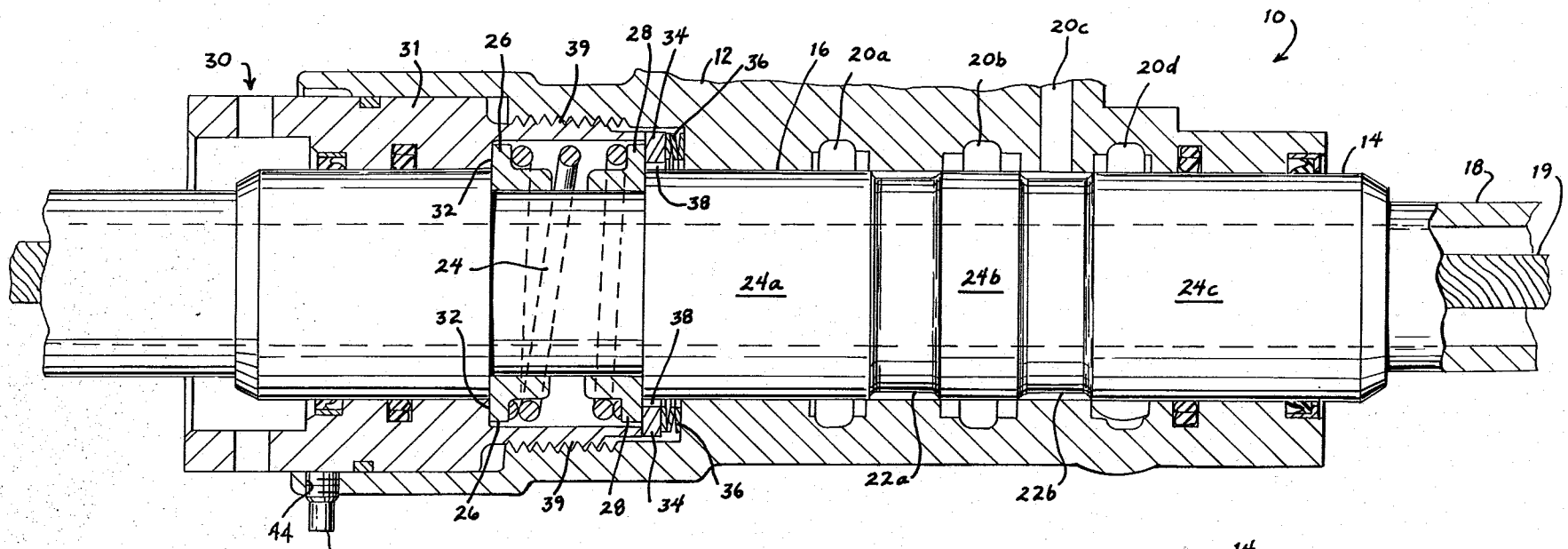
FIG. 1 is a side cross-sectional view of a valve constructed according to the present invention.
Figure 2:
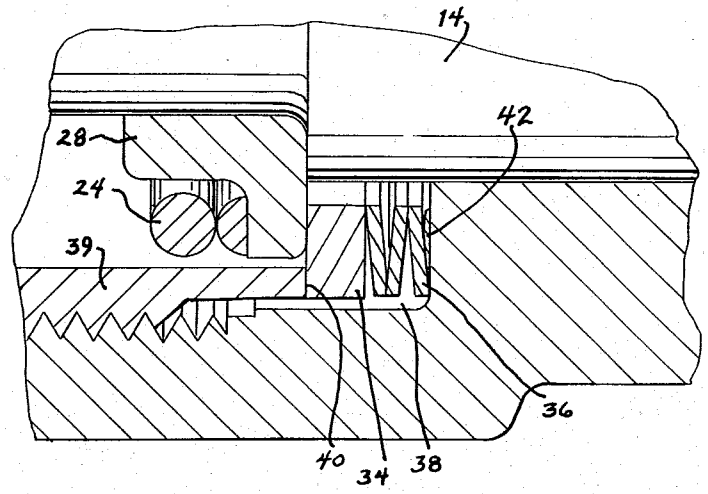
FIG. 2 is an enlarged side cross-sectional view of the axially adjustable spring seat shown in FIG. 1.

In FIG. 1 a hydraulic valve 10 is shown having a valve body 12 and a valve spool 14. Valve spool 14 is disposed for axial movement within bore 16 and a coaxial steering cable has its outer jacket, not illustrated, attached to the valve spool end 18 and its core 19 attached to the valve body 12 through the steering bracket, not illustrated, as shown in U.S. Pat. No. 4,595,370, hereby incorporated by reference. The steering cable is thus operatively connected to spool 14 so that relative movement of the cable jacket and cable core 19 caused by a steering wheel (not shown) will result in axial movement of spool 14.

Valve body 12 is provided with ports or passageways **20*a* through 20*d* and spool 14 is provided with spaced peripheral grooves 22*a* and 22*b* defined by lands 24*a* through 24*c*. Peripheral grooves 22*a* and 22*b* selectively connect the various ports and passages in valve body 12**.

Valve spool 14 is also provided with a centering spring 24 which is held in position on valve spool 14 by spring retainers 26 and 28. Centering spring 24 will return spool 14 to its neutral position (shown in FIG. 1) when the external force which has moved spool 14 to the left or right of its neutral position has been removed.

Since it is desirable to have a minimum amount of leakage between ports and passages **20*a* through 20*d*, it is necessary to precisely position valve spool 14 within bore 16. To this end, hydraulic valve 10 has been provided with adjustment means 30 which includes a cylindrical sleeve 31 connected to valve spool 14 and threaded into valve body 12. Cylindrical sleeve 31 is provided with a radial abutment surface 32 that provides a seat for the left end of spring 24**.

The seat for the right end of spring 24 is provided by one face of spacer 34. The inner face of spacer 34 engages biasing means 36 which may be a Belleville spring or compressible washers. Both spacer 34 and biasing means 36 are contained within a cavity 38 in valve body 12.

Axial adjustment of spacer 34 is accomplished by means of leg 39 that is integral with cylindrical sleeve 31. Leg 39 terminates in a radial abutment surface 40 that engages a portion of the face of spacer 34. Thus, axial movement of leg 39 will cause axial movement of spacer 34.

Valve body 12 is provided with a threaded hole 44 in which set screw 46 is disposed. When tightened set screw 46 engages sleeve 31 and prevents the inadvertent movement of sleeve 31.

In operation spool 14 is positioned approximately within bore 16 and then fine tuned by means of adjustment means 30. For example, if spool 14 had to be moved slightly to the right in order to position grooves **22*a* and 22*b* and lands 24*a*, 24*b* and 24*c* in their final position, cylindrical sleeve 31 would be rotated so as to cause left to right movement of spool 14. This left to right movement of cylindrical sleeve 31 would also cause left to right movement of abutment surface 32 and leg 39 would cause left to right movement of spacer 34 within cavity 38. Thus, movement of sleeve 31 causes simultaneous movement of spool 14, spring 24 and its associated spring seats 32 and 34. It can also be seen that right to left movement of sleeve 31 results in right to left movement of spool 14 and seats 32 and 34. The right to left movement of seat 34 being caused by biasing means 36 acting on the right hand face of spacer 34 and radial wall 42 of cavity 38**.

It is recognized that various alternatives and modifications are possible in the scope of the appended claims.

We claim:

1. In a valve of the type utilizing a cylindrical spool slidably mounted in a bore in a valve body and centered in the bore by a centering spring an adjustment assembly for axially positioning the spool and centering spring for the spool within the bore of a valve body, said assembly comprising:

adjustment means operatively connected to the spool so that axial movement of said adjustment results in axial movement of the spool within the bore, a first spring seat disposed on said adjustment means for the centering spring whereby axial movement of said adjustment means results in axial movement of said first seat and the centering spring, a second spring seat disposed for axial movement within a cavity in the valve body and biasing means urging said second spring seat into contact with said adjustment means, and positioning means operatively connected to said adjustment means and said second spring seat so that axial movement of said adjustment means results in axial movement of said second spring seat in said cavity and axial movement of the centering spring.

2. The adjustment assembly of claim 1 wherein said adjustment means comprises a cylindrical sleeve disposed around and connected to the cylindrical surface of the spool.

3. The adjustment assembly of claim 2 wherein said first spring seat comprises a radial abutment surface on said cylindrical sleeve.

4. The adjustment assembly of claim 2 wherein said positioning means comprises a leg integral with and axially extending from said cylindrical sleeve, said leg terminating in a radial abutment surface that engages said second spring set.

5. The adjustment assembly of claim 1 wherein said second spring seat comprises a spacer disposed within said cavity, said spacer having an outer surface engageable with the centering spring and inner surface engageable with said biasing means, said biasing means disposed within said cavity between said spacer and said radial wall of said cavity.

6. The adjustment assembly of claim 1 further comprising locking means operably connected to said adjustment means to prevent inadvertent movement of said adjustment means.

7. In a valve of the type utilizing a cylindrical spool slidably mounted in a bore in a valve body and centered in the bore by a centering spring an adjustment assembly for axially positioning the spool and centering spring for the spool within the bore of the valve body, said assembly comprising:

a cylindrical sleeve disposed around and connected to the cylindrical surface of the spool, so that axial movement of the cylindrical sleeve results in axial movement of the spool within the bore, a radial abutment on said cylindrical sleeve defining a first spring seat for the centering spring so that axial movement of said cylindrical sleeve results in axial movement of said first spring seat and the centering spring, a second spring seat disposed for axial movement within a cavity in the valve body and biasing means urging said second spring seat into contact with said cylindrical sleeve, and a leg integral with and axially extending from said cylindrical sleeve, said leg terminating in a radial abutment surface that engages said second spring seat so that axial movement of said cylindrical sleeve results in axial movement of said second spring seat in said cavity and axial movement of the centering spring.

* * * * *